United States Patent [19]

Goldberg et al.

[11] 4,374,492

[45] Feb. 22, 1983

[54] ANTIPERSONNEL MINE

[75] Inventors: Ernest Goldberg, Westford; Gray C. Trembly, Arlington; William A. Zarr, Concord, all of Mass.

[73] Assignee: Raytheon Company, Lexington, Mass.

[21] Appl. No.: 673,019

[22] Filed: Apr. 2, 1976

[51] Int. Cl.[3] ..... F42C 11/06

[52] U.S. Cl. ..... 102/220; 102/427

[58] Field of Search ..... 102/70.2 R, 19.2

[56] References Cited

U.S. PATENT DOCUMENTS

| | | | |
|---|---|---|---|
| 2,404,553 | 7/1946 | Wales, Jr. | 102/70.2 R |
| 2,545,474 | 3/1951 | Kurland et al. | 102/70.2 R |
| 2,910,001 | 10/1959 | Ruehlemann et al. | 102/70.2 R |
| 2,985,837 | 5/1961 | Ruehlemann et al. | 102/70.2 R |
| 3,439,616 | 4/1969 | Godsey et al. | 102/70.2 R |
| 3,700,968 | 10/1972 | Spies | 102/70.2 R |

*Primary Examiner*—Charles T. Jordan

*Attorney, Agent, or Firm*—Philip J. McFarland; Joseph D. Pannone

[57] ABSTRACT

An antipersonnel mine is shown, a plurality of such mines being adapted to be loaded into a round of ammunition for dispersal and subsequent detonation at random instants. The timing for detonation of each mine is determined by the discharge of a capacitor, starting when dispersal occurs. The condition of the explosive lead of each mine before loading is indicated by a position indicator in the safing and arming mechanism.

3 Claims, 6 Drawing Figures

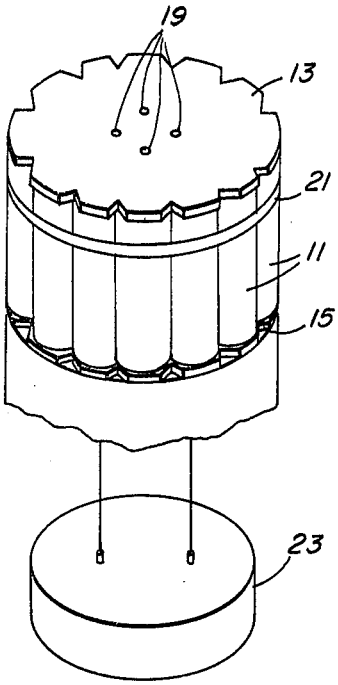
FIG. 1
FIG. 2
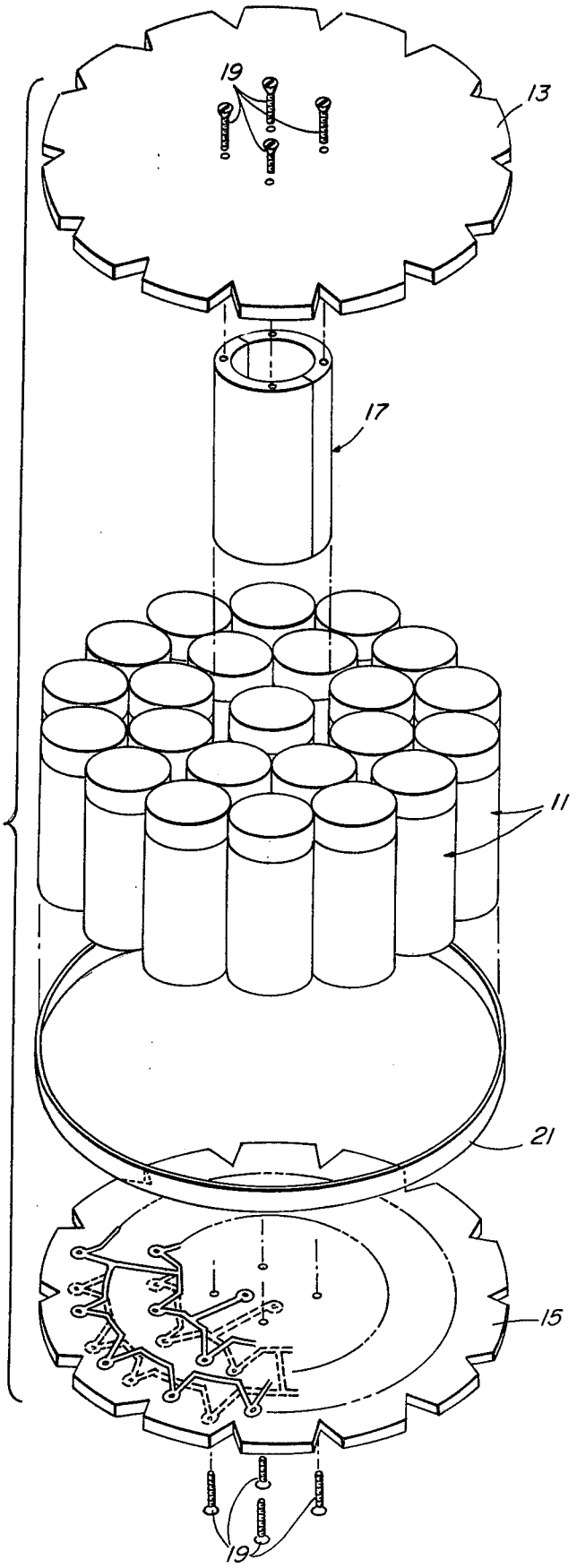

FIG. 3
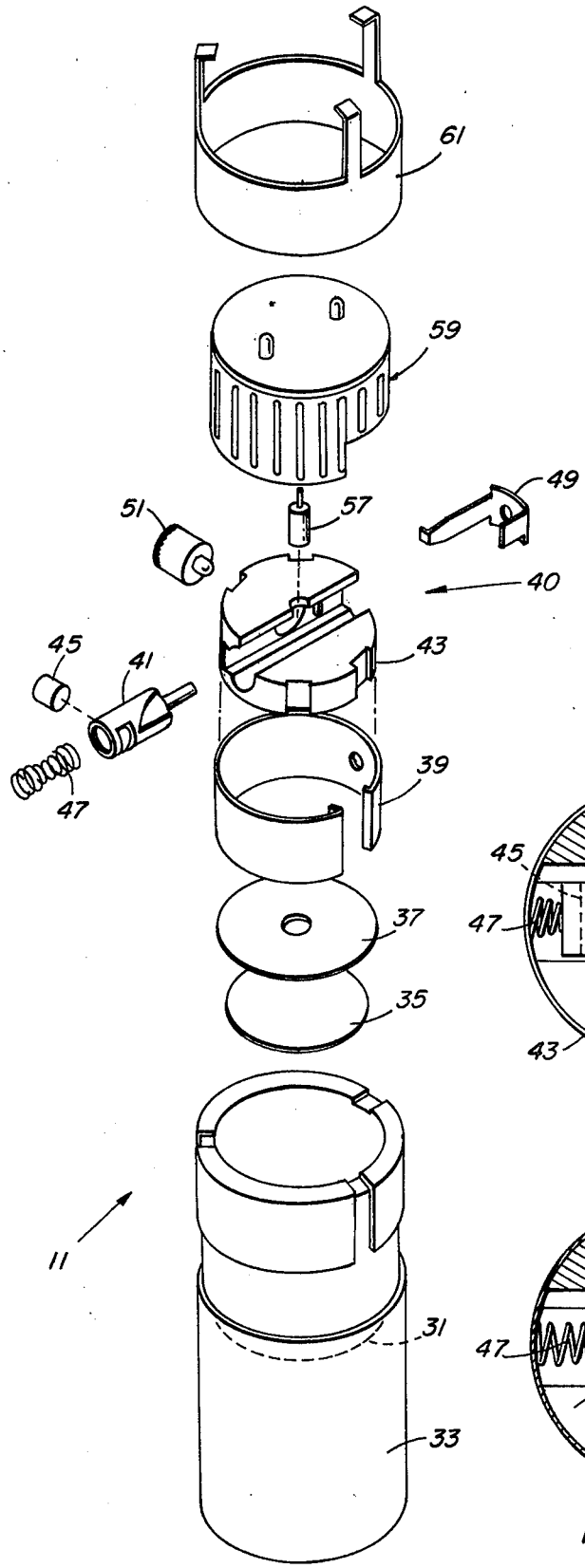
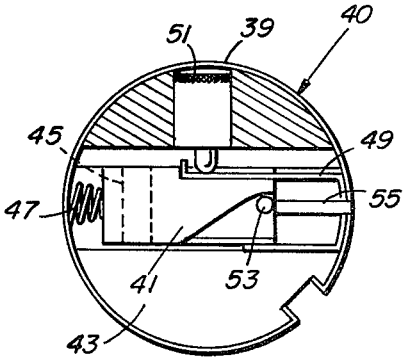
FIG. 3A
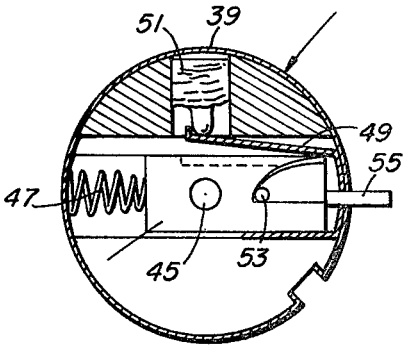
FIG. 3B

ANTIPERSONNEL MINE

The invention herein described was made in the course of or under a contract or subcontract thereunder, with the Department of Defense.

BACKGROUND OF THE INVENTION

This invention pertains generally to munitions and particularly to explosive charges and the means for detonating such charges.

It has been an accepted military practice in many tactical situations to interdict movement of enemy personnel by dispersing antipersonnel mines in a particular area. It is, of course, very important that any such mines meet the following criteria: (a) be adapted for dispersal from different types of ordnance, as from artillery shells, rockets or bombs; (b) be safe to handle, even after an extended period in storage under adverse environmental conditions, before dispersal; (c) be effective for a predetermined length of time after dispersal; and (d) be as inexpensive as possible to manufacture. Unfortunately, there is no known type of antipersonnel mine which meets the listed criteria.

SUMMARY OF THE INVENTION

Therefore, it is a primary object of this invention to provide an improved antipersonnel mine that meets the listed criteria.

The foregoing and other objects of this invention are attained generally in an improved antipersonnel mine by the combination of a detonator having a visible indicator of its condition, i.e. an indicator of whether the detonator is "safe" or "armed", and an electronic timer, operative only when the detonator is armed during operation, to actuate the detonator at the end of an interval of time after the detonator is armed. In a preferred embodiment of this invention, each antipersonnel mine is small enough so that a plurality of such mines may be loaded in a carrier within an artillery round, a rocket or a bomb to be dispersed over an area to be interdicted. Upon being dispersed, each one of the plurality of antipersonnel mines is armed and the electronic timer in each is actuated with the result that, at random instants within a predetermined interval of time, different ones of the mines are detonated.

BRIEF DESCRIPTION OF THE DRAWINGS

For a more complete understanding of this invention reference is now made to the following description of the accompanying drawings wherein:

FIG. 1 is a sketch showing a plurality of antipersonnel mines, having detonators according to this invention, assembled in a substantially cylindrical package ready for insertion in a round of ammunition;

FIG. 2 is an exploded view of the package shown in FIG. 1;

FIG. 3 is an exploded view of a single one of the antipersonnel mines shown in FIGS. 1 and 2;

FIGS. 3A and 3B are sketches showing the safety and firing positions of the detonator assembly shown in FIG. 3.

DESCRIPTION OF THE PREFERRED EMBODIMENT

Figure 4:
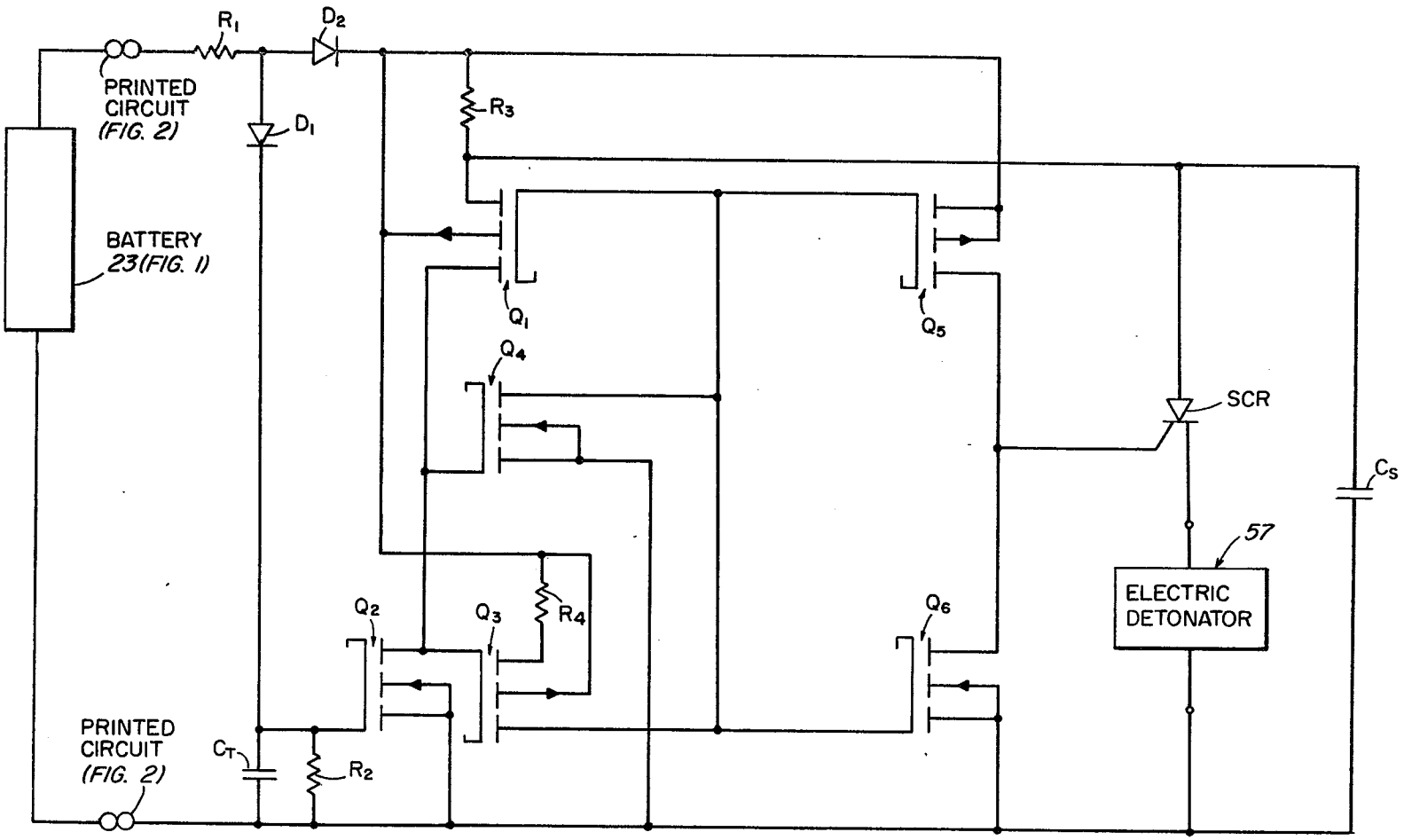
FIG. 4 is a circuit diagram of the timing circuit here contemplated.

Referring now to FIGS. 1 and 2, it may be seen that it is contemplated here that a plurality of antipersonnel mines, such as those numbered 11, be assembled to form a substantially cylindrical package adapted to be inserted in the body of a round of ammunition, as an artillery shell, a rocket or a bomb (not shown). To form such a package, the individual antipersonnel mines 11 are placed between a pair of flanges 13, 15 (with the centrally placed one of such mines within a spacer 17 (here a matching pair of half-cylindrical members (not numbered) as shown in FIG. 2. The spacer 17 is connected to the flanges 13, 15 by screws 19 and a band 21 is wrapped around the outside of the plurality of antipersonnel mines 11. A printed circuit is disposed on the flange 15 to connect each one of the plurality of antipersonnel mines 11 across a battery 23 (shown in phantom in FIG. 1) which is also loaded into the round of ammunition. The material from which the flanges 13, 15, the spacer 17, the screws 19 and the band 21 are made is not essential to the invention provided only that each one of the mentioned elements is made from a material which is destroyed by either the shock or the heat attendant upon detonation of the charge in the round of ammunition in which the package of antipersonnel mines 11 is loaded. Obviously, in addition, the flange 15 must be made from an electrically nonconductive material.

It will now be apparent that the individual antipersonnel mines 11 in the package, upon detonation of the round of ammunition carrying such package above an area to be interdicted, will be dispersed over such area. The coverage pattern of such mines will, of course, be dependent upon the number in a package and the height at which detonation of the round of ammunition occurs. It will also be apparent that the connection between the battery 23 and the individual ones of the antipersonnel mines will be broken upon detonation of the round of ammunition. Upon rupture of the electrical connection between the battery 23 and the individual ones of the antipersonnel mines 11, an electronic timer (to be described in connection with FIG. 4) in each individual one of the antipersonnel mines is actuated. With each such timer set (again in a manner to be described) to actuate a detonator (to be described in connection with FIG. 3) at a randomly determined instant after actuation, individual ones of such mines are caused to detonate at random instants until all are detonated.

Referring now to FIG. 3, the details of the mechanical portions of an antipersonnel mine 11 according to this invention may be seen. Thus, an explosive charge 31 is loaded in any conventional manner within a frangible body 33 and an explosive lead assembly (now to be described) is secured adjacent to such charge, but separated therefrom by a membrane 35 and a baffle 37 having an opening centrally formed therein as shown. Overlying the baffle 37, and contained within a retainer clip 39, is a safety and arming mechanism 40. Thus, a slide 41 is supported within a block 43. An explosive lead 45 is fitted into a hole (not numbered) in the slide 41. An actuating spring 47 is disposed between the slide 41 and the retainer clip 39. A spring member, or sear 49, (mounted on the block 43 in any convenient manner) is disposed so that its free end fits in a slot (not numbered) in the slide 41. The sear 49 is held in contact with the slide 41 by pressure exerted by a latch 51. The just-mentioned element here is a conventional device comprising a hollow body which is crushed by the shock wave from the explosive charge in the round of ammunition in which the package of antipersonnel mines is carried. As is shown in FIG. 3A, the sear 49, once engaged, prevents any motion of the slide 41 in response to the urging of the actuating spring 47.

A cam surface (not numbered) is formed in any convenient way on the surface of the slide 41 and a pin 53 is affixed to the block 43 to coact with the cam surface. A second safety and position indicator 55 (here formed an integral part of the slide 41 by turning one end of such slide) completes the safety and arming mechanism 40. When the hollow body of the latch 51 is crushed, the sear 49 moves into a relief channel (not numbered) in the block 43. The actuating spring then causes the slide to move until the explosive lead 45 is positioned as shown in FIG. 3B. It is noted that the second safety and position indicator 55 then projects outwardly from the safety and arming mechanism 40. When the explosive lead is positioned as shown in FIG. 3B, it is aligned with an electric detonator 57 supported in a firing circuit 59 (described in more detail in connection with FIG. 4).

Before referring specifically to FIG. 4, it will be noted that detonation at random instants in time (after dispersal) of the different ones of the antipersonnel mines 11 is here controlled by an electronic timing circuit in each one of such mines. As will be seen, the contemplated electronic timing circuit is, for the sake of safety, inhibited from operation until the antipersonnel mines 11 in a round of ammunition are dispersed. The principle of operation of the contemplated electronic timing circuit is that the instant at which the electric detonator 57 (FIG. 3) in any given one of the antipersonnel mines 11 is actuated may be determined by controlling the instant at which the voltage across an initially charged capacitor decays to a predetermined level. It follows, then, that if the time constants of the discharge paths of individual ones of such capacitors dispersed from a round of ammunition are selectively varied, then the instant at which detonation of individual ones of the antipersonnel mines 11 occurs may be controlled. It will be noted also that the contemplated electronic timing circuit ensures the detonation of all dispersed antipersonnel mines 11 during a predetermined interval after dispersal.

With the foregoing in mind it may be seen that the electronic timing circuit shown in FIG. 4 is first connected (via the printed circuits (FIG. 2) on the flange 15) so that current passes through a limiting resistor $R_1$ and a diode, $D_1$, to charge a timing capacitor $C_T$. At the same time current passes through the limiting resistor $R_1$, a diode $D_2$, and a resistor $R_3$ to charge a capacitor $C_S$ (sometimes referred to herein as the energy storage capacitor). The time constant of the charging path for the timing capacitor $C_T$ is less than one-tenth the time constant of the energy storage capacitor $C_S$ so transistor $Q_2$ is, perforce, the first of the transistors to conduct. As soon as transistor $Q_2$ conducts, the bias on the gate electrode of transistor $Q_3$ (a P channel transistor), derived through the then existing low impedance between the source and drain electrodes of transistor $Q_2$, and the bias on the source electrode of transistor $Q_3$, derived through resistor $R_4$ and the diode $D_2$, are such as to cause that transistor to conduct. It follows, then, that a transistor $Q_6$ (an N channel transistor) is also caused to conduct by reason of the fact that its gate electrode is connected (through conducting transistor $Q_3$, resistor $R_4$, diode $D_2$ and resistor $R_1$) to the high side of the battery 23 and its source electrode is connected to the low side of such battery. With transistor $Q_6$ conducting, the control electrode of a silicon controlled rectifier, here labeled SCR, is clamped to the same voltage as the source electrode of transistor $Q_6$ with the result that the SCR is inhibited from conducting as the voltage across energy storage capacitor $C_S$ increases.

The remaining transistors, i.e. transistor $Q_1$, transistor $Q_4$ and transistor $Q_5$ are biased to their nonconducting states when transistors $Q_2$, $Q_3$ and $Q_6$ are conducting. Thus, (a) the voltage on the source electrode of the transistor $Q_1$ (which is a P channel transistor) follows the voltage across the energy storage capacitor and the voltage across the gate electrode of the transistor $Q_1$ is the same as the voltage on the drain electrode of transistor $Q_3$; (b) the voltage on the gate electrode and the voltage on the source electrode of transistor $Q_4$ (an N channel transistor) are clamped to the low side of the battery 23; and (c) the voltage on the gate electrode of transistor $Q_5$ (a P channel transistor) is the same as the voltage on the drain electrode of transistor $Q_3$ and the voltage on the source electrode of transistor $Q_5$ is the same as the voltage at diode $D_2$. Under such conditions, transistors $Q_1$, $Q_4$ and $Q_5$ are cut off and remain cut off as the energy storage capacitor $C_S$ charges.

It will be evident that as long as the battery 23 remains connected, the just-described circuitry will operate as just described. That is to say, until separation of the battery 23 occurs when the individual antipersonnel mines 11 are dispersed in the area to be interdicted, the SCR cannot be actuated.

When separation of the battery occurs, the timing capacitor $C_T$ begins to discharge. The discharge path for the timing capacitor $C_T$ is the parallel combination of resistor $R_2$ and the path from the gate electrode to the source electrode of transistor $Q_2$. The resistance of the path from the gate electrode to the source electrode of the transistor $Q_2$ is, however, far greater than the resistance of resistor $R_2$. The time constant for discharge of the timing capacitor $C_T$ may, therefore, be taken to be determined by the capacitance of the timing capacitor $C_T$ and the resistor $R_2$. When the voltage across the timing capacitor $C_T$ goes below the threshold voltage required to maintain transistor $Q_2$ in its conductive state, that transistor becomes cut off to initiate the final operation of the circuitry being described. Thus, when transistor $Q_2$ becomes nonconductive, the impedance between the source electrode and the drain electrode of that transistor increases to approximately the same impedance as then exists between the source electrode and the drain electrode of transistor $Q_1$. It follows then that the voltage at the junction between the transistors $Q_1$, $Q_2$ (which constitute a voltage divider across the energy storage capacitor $C_S$) rises to switch transistor $Q_4$ into its conductive state and to switch transistor $Q_3$ into its nonconductive state. The switching of transistors $Q_3$, $Q_4$ then causes transistors $Q_1$, $Q_5$ and $Q_6$ to switch with the final result that the voltage on the control electrode of the SCR rises. That element then is switched to its conductive state and the energy remaining in the energy storage capacitor $C_S$ is passed as a pulse of electrical current through the SCR to the electric detonator 57 (FIG. 3) which is then caused to fire the explosive lead 45 which in turn detonates the explosive charge 31.

It will be apparent to one of skill in the art that, because the moment at which final operation is initiated is determined by the time constant of the discharge path of the timing capacitor $C_T$, different values of the resistor $R_2$ in the individual ones of the antipersonnel mines 11 dispersed over an area to be interdicted may be selected to cause explosions to occur at random until all of such mines are detonated. It will also be evident to one of skill in the art that the described circuitry may be arranged, if desired, to have the timing interval of each antipersonnel mine 11 remain substantially the same over a relatively wide range of ambient temperatures. Thus, because the threshold voltage level for switching transistor $Q_2$ from its conductive to nonconductive state is directly related to ambient temperature, the resistor $R_2$ may be fabricated from a material having a negative temperature coefficient of conductivity to maintain a constant timing interval.

It will, still further, be apparent to one of skill in the art that to achieve the requisite control over the time constant of the discharge path of the timing capacitor $C_T$ and to maintain a sufficient charge across the energy storage capacitor $C_S$, the various elements in the disclosed circuit must exhibit inherently low leakage characteristics. In addition to inherently low leakage characteristics the various elements must be relatively impervious to changing environmental conditions, especially to changes in humidity. Thus it has been found that the following types of devices, when mounted on a ceramic substrate (not shown), are satisfactory:

Diodes $D_1$, $D_2$:
Type IN3595
Resistors $R_1$, $R_3$, $R_4$:
Allen Bradley Co., hot molded resistors, type RCRO5
Resistor $R_2$:
Eltec Instruments, Inc. Model 104
Capacitors $C_1$, $C_2$:
Metallized polycarbonate, 50 V Active & Passive Components, Inc.

Having described a preferred embodiment of this invention, it will now be apparent to one of skill in the art that the particular elements of such embodiment may be changed without departing from our inventive concept. It is felt, therefore, that this invention should not be restricted to its disclosed embodiment but rather should be limited only by the spirit and scope of the appended claims.

What is claimed is:

1. In an antipersonnel mine incorporating a delayed action electrical detonator, an improved timing arrangement for actuating such detonator, such arrangement comprising:

(a) a first and a second capacitor;
(b) means for charging the first and the second capacitor and maintaining the charge on both capacitors until a timing period is to be initiated;
(c) resistor means, operative when a timing period is initiated, for discharging the first capacitor according to a preselected time constant; and
(d) electronic switching means, interposed between the second capacitor and the electrical detonator, such switching means being latched in an unactuated state by the charge on the first capacitor during the timing period and being actuable by the charge on the second capacitor only at the end of the timing period to discharge the second capacitor through the electrical detonator when the first capacitor is discharged to a predetermined level, such switching means including:
(i) a silicon controlled rectifier having the second capacitor connected to its anode electrode and the electrical detonator connected in series with the silicon controlled rectifier;
(ii) means, including a first normally conducting field effect transistor, for grounding the control electrode of the silicon controlled rectifier during the timing period; and
(iii) means, including a second normally nonconducting field effect transistor, for rendering such first field effect transistor nonconducting and for rendering such second field effect transistor conducting to connect the second capacitor to the control electrode of the silicon controlled rectifier at the end of the timing period.

2. An improved timing arrangement as in claim 1 wherein the last two named means and the first and the second field effect transistors are complementary transistors in an integrated circuit, each one of such transistors having a high input impedance.

3. An improved timing arrangement as in claim 2 wherein the integrated circuit, the first and the second transistors and the resistor means are mounted on a common base.

* * * * *